US005376489A

United States Patent [19]

Yabe et al.

[11] Patent Number: 5,376,489

[45] Date of Patent: Dec. 27, 1994

[54] TWO-COMPONENT DEVELOPER

[75] Inventors: Naruo Yabe, Kobe; Tetsuya Nakano, Nabari; Masahide Inoue, Nara; Teruaki Teratani, Mino; Koichi Tsuyama, Kobe; Yoshitake Shimizu, Kyoto; Seijiro Ishimaru, Ibaraki, all of Japan

[73] Assignee: Mita Industrial Co., Ltd., Osaka, Japan

[21] Appl. No.: 946,154

[22] Filed: Sep. 17, 1992

Related U.S. Application Data

[63] Continuation of Ser. No. 698,126, May 10, 1991, abandoned.

[30] Foreign Application Priority Data

| | | | |
|---|---|---|---|
| May 18, 1990 | [JP] | Japan | 2-129796 |
| May 18, 1990 | [JP] | Japan | 2-129797 |
| May 18, 1990 | [JP] | Japan | 2-129798 |
| Jun. 26, 1990 | [JP] | Japan | 2-167799 |

[51] Int. Cl.[5] ..... G03G 9/113; G03G 9/087

[52] U.S. Cl. ..... 430/106.6; 430/108; 430/109; 430/111

[58] Field of Search ..... 430/108, 109, 111, 106.6

[56] References Cited

U.S. PATENT DOCUMENTS

| | | | |
|---|---|---|---|
| 3,718,594 | 2/1973 | Miller | 430/108 |
| 4,042,517 | 8/1977 | Moriconi et al. | 252/621 P |
| 4,882,258 | 11/1989 | Ikeuchi et al. | 430/108 |

*Primary Examiner*—Roland Martin

*Attorney, Agent, or Firm*—Beveridge, DeGrandi, Weilacher & Young

[57] ABSTRACT

The developer in accordance with the present invention includes toner, and a carrier having a core material the surface of which is coated with a coating layer made of a polymer, the coating layer having a resistance value sufficient to minimize the counter electric charge remaining in the coating layer, and the toner having any of characteristic values required for preventing a counter electric charge remaining in the coating layer from being increased. The use of the developer of the present invention not only prevents the occurrence of so-called carrier scattering, to thereby prevent blanking, but also produces an image of high quality having a high initial image density.

6 Claims, 4 Drawing Sheets

$\frac{V}{P} = 0.14$

SH:SL=25:75

$\frac{V}{P} = 0.309$

SH:SL = 30:70

$\frac{V}{P} = 0.152$

SH:SL = 24:76

TWO-COMPONENT DEVELOPER

This application is a continuation of application Ser. No. 07/698,126, filed May 10, 1991, now abandoned.

BACKGROUND OF THE INVENTION

The present invention relates to a two-component developer, and more particularly to a two-component developer used in an image forming apparatus such as an electrostatic copying apparatus.

In an image forming apparatus such as a copying apparatus, there is widely used a so-called Carlson process comprising the steps of: uniformly charging a photosensitive material with electricity by corona discharge; exposing the charged photosensitive material to light, thereby to form an electrostatic latent image corresponding to a document image; developing the electrostatic latent image by a developer, thereby to form a toner image; transferring the toner image to a medium such as paper; and fixing the toner image transferred to the medium.

As the developer used in the developing step, there is widely used a two-component developer comprising a carrier and toner. The carrier comprises a core material and a coating layer made of a polymer which coats the surface of the core material. The carrier causes the toner to be positively or negatively charged by friction charging. The carrier also causes the toner to be sticked to the surface thereof, and supplies the toner to the surface of the electrostatic latent image.

In electrostatic copying using a conventional two-component developer, however, there occurs a phenomenon which is generally called "carrier scattering" that the carrier together with the toner is adhered or sticked to the surface of an electrostatic latent image. This may produce fine white spots on the resultant copied image. Such white spots are also called blanking.

The following may be presumed as the cause of such carrier scattering.

By the edge effect (edge phenomenon) that the density of the image at the center portion thereof is thinner than at the periphery portion thereof, the potential of the periphery portion of the image is lower in level than the residual potential. Accordingly, the photosensitive drum presents potential difference $V_1$ between the potential of the black peripheral portion of a black (solid-black) image (1) and the residual potential, as shown in FIG. 1. In an adjacent-line image (2), potential difference $V_2$ between the potential between adjacent lines, and the residual potential is influenced by the potential of the outer peripheral portions of both adjacent lines. Accordingly, the potential difference $V_2$ is greater than $V_1$ ($V_2$ is approximately equal to $2V_1$). In a fine-mesh image (3), potential difference $V_3$ between the potential of the white portion surrounded by the respective lines and the residual potential becomes greater than the potential difference $V_2$ of the adjacent-line image (2) ($V_3$ is greater $V_2$ which is greater than $V_1$). On the other hand, a bias voltage having the same polarity as that of the electrostatic latent image is applied to the sleeve of the image forming apparatus. Accordingly, the carrier separated from the sleeve is liable to be adhered to the image peripheral portion based on the principle of inversion phenomenon, thus producing carrier scattering. Such carrier scattering is apt to appear frequently in the order of the solid-black image (1), the adjacent-line image (2) and the mesh image (3), as apparent from the description hereinbefore.

SUMMARY OF THE INVENTION

It is a main object of the present invention to provide a two-component developer which prevents the phenomenon of carrier scattering from taking place and which restrains blanking caused by carrier scattering, if any, to such an extent as to present no problem in view of practical use.

The carrier scattering wherein the carrier is sticked to the surface of electrostatic latent image, is considered to be caused by the mutual action of the electric line of force in the vicinity of the photosensitive material with the counter electric charge (accumulated electric charge) remaining in the carrier when the toner is separated from the carrier at the time of development. As the counter electric charge is greater, the carrier scattering takes place more often.

It has been considered that the size of the counter electric charge is determined by the resistance value of the entire carrier (normally in the range from $10^7$ to $10^{12}$ ohms/cm). The inventors of the present invention have studied hard and found the novel fact that the carrier scattering does not correlate to the resistance value of the entire carrier and that the carrier scattering is caused by increase in the counter electric charge of the coating layer made of a polymer which covers the carrier surface. To prevent the carrier scattering, it should be taken into consideration to adjust, in the respective optimum ranges, (i) the resistance value of the carrier coating layer which has a great influence upon the counter electric charge, and (ii) the toner characteristic values which constitute a primary factor for changing the counter electric charge in the coating layer.

More specifically, as the resistance value of the coating layer is greater, the tendency that the counter electric charge remains in the coating layer becomes greater. The carrier having a high counter electric charge is liable to be stuck to the surface of the electrostatic latent image, thus causing the carrier scattering to take place more easily.

The toner characteristic values which constitute a primary factor for changing the counter electric charge in the coating layer, include toner particle size, conductivity, compressed degree and the molecular-weight distribution of fixing resin components contained in the toner. More specifically, when an image is developed with toner having a large particle size, a great counter electric charge remains in the carrier coating layer (it is generally believed that the counter electric charge in proportion to the third power of the toner particle size remains in the coating layer), so that the carrier scattering frequently takes place.

When the toner conductivity is low, the resistance is increased, causing the toner electric charge to be increased. When an image is developed with toner having a high electric charge, the counter electric charge in the carrier coating layer is increased, resulting in frequent occurrence of the carrier scattering.

When the toner compression degree is high, the toner is decreased in flowability, resulting in dispersion in the amount of toner sticked to each carrier particle. If the amount of toner adhered to one carrier is small, the attraction force between the carrier and the toner is increased, causing the toner to be separated from the carrier with difficulty. On the contrary, when the amount of sticked toner is great, the density of an image after development, is increased, but the counter electric charge remaining in the carrier coating layer is also increased. This results in frequent occurrence of the carrier scattering.

The term 'compression degree' herein used refers to a notion which represents the flowability of a particle, and is expressed by the following equation:

$$\text{Compression Degree} = \frac{(\text{Hard Apparent Density} - \text{Loose Apparent Density})}{(\text{Hard Apparent Density})} \times 100(\%)$$

In the equation above-mentioned, the 'loose apparent density' may be obtained from the weight of 100 cc of toner which has been passed through a sieve of 100 meshes and allowed to naturally drop into a cell of 100 cc.

The 'hard apparent density' may be obtained as follows. An extension cell is mounted on the cell above-mentioned as it is after the measurement of the loose apparent density, and the toner is tapped for 180 seconds at one time/second to compress a toner mixture. From the volume of the toner mixture thus compressed and the weight above-mentioned, the hard apparent density is obtained. This hard apparent density presents a substantially constant value regardless of the mixing period of time as far as the amounts of fixing resin components, a coloring agent and the like contained in the toner are constant.

Reference is further made to the molecular-weight distribution of the fixing resin components in the toner. When a high-molecular-weight component and a low-molecular-weight component are jointly contained in the fixing resin, the resin composition in the toner becomes uneven or the internal agglomeration force is lowered. As the result, the toner is liable to be agglomerated, so that the toner particles as agglomerated are apt to be sticked to each carrier particle. When an image is developed with such agglomerated toner, a great counter electric charge remains in the carrier coating layer, resulting in frequent occurrence of the carrier scattering.

The two-component developer in accordance with the present invention comprises toner and a carrier having a core material of which surface is coated with a polymer coating layer, the coating layer having a resistance value sufficient to minimize the counter electric charge remaining in the coating layer.

Preferably, the two-component developer in accordance with the present invention comprises a carrier coated with the coating layer having the resistance value above-mentioned, and toner so arranged as to minimize the counter electric charge remaining in the coating layer.

In the carrier in accordance with the present invention, the quotient obtained by dividing the resistance value of the carrier core material by the carrier resistance value is not less than 0.020. The quotient of the resistance value of the carrier core material divided by the resistance value of the carrier, indirectly represents the resistance value of the coating layer, since it is difficult to measure only the resistance value of the coating layer. When the quotient of the resistance value of the carrier core material divided by the carrier resistance value is set to not less than 0.020, the resistance value of the carrier coating layer becomes small, so that the ability of holding the counter electric charge in the coating layer is made proper. This prevents the occurrence of carrier scattering.

The toner characteristic values including particle size, conductivity, compression degree and the molecular-weight distribution of fixing resin components are determined as set forth below. The toner in accordance with the present invention is not required to satisfy all the characteristic values above-mentioned. To restrain the occurrence of carrier scattering to such an extent as to present no problem in view of practical use, it is sufficient that the toner satisfies at least one of the characteristic values above-mentioned.

(1) The toner contains toner particles having a particle size not less than 16 μm in an amount of not greater than 1.5% in terms of the number of toner particles. This reduces that rate of a great counter electric charge generated by the use of toner having a large particle size, which remains in the carrier coating layer made of a polymer. This reduces the frequency at which the carrier scattering takes place.

(2) The toner conductivity is not less than $3.0\times10^{-10}$ S/cm. This reduces not only the amount of toner electric charge, but also the counter electric charge remaining in the coating layer, thus further preventing the occurrence of carrier scattering.

(3) The toner compression degree is not greater than 40%. This improves the toner in flowability to make uniform the number of toner particles sticked to each carrier particle. Accordingly, there exists no carrier particle of which counter electric charge is outstandingly great. This further prevents the occurrence of carrier scattering.

(4) The fixing resin components in the toner are a styrene-acrylic thermoplastic resin of which gel permeation chromatogram shows the molecular-weight distribution in which the high-molecular-weight maximum value is located in the side higher than the molecular weight of $1\times10^5$ the low-molecular-weight maximum value is located in the range of molecular weight from $2\times10^4$ to 500, and the minimum value is located between the two maximum values above-mentioned, and in which the ratio of the area of the valley part containing the minimum value to the total sum of the high- and low-molecular-weight peak areas, is not greater than 0.30. This remarkably improves the toner fixing resin in internal agglomeration force to prevent the toner from being agglomerated, while assuring excellent low-temperature fixing properties and excellent resistance to off-set. More specifically, the thermoplastic resin used as the fixing resin in the present invention, is characterized in that there is contained a great amount of component of which molecular weight is commonly located in both peak areas, even though there is difference in molecular weight as great as $8\times10^4$ between the high-molecular-weight maximum value $P_H$ and the low-molecular-weight maximum value $P_L$.

FIG. 2 shows how to obtain the ratio (V/P) of the valley area to the peak area. In this gel permeation chromatogram (GPC), there are observed the high-molecular-weight maximum value $P_H$, low-molecular-weight maximum value $P_L$ and the minimum value $V_M$ therebetween. There are obtained a high-molecular-weak peak area $S_H$ located in the side higher than this molecular-weight minimum value $V_M$, a low molecular-weight peak area $S_L$ located in the side lower than the minimum value $V_M$, and a valley area $S_V$ located below a common tangential line L which connects both maximum values $P_H$ and $P_L$. Thus, the following equation is calculated:

$$V/P = \frac{S_V}{S_H + S_L}$$

The ratio (V/P) of the valley area to the peak area represents how the two-peak curve of molecular-weight distribution is approximated to a quadrilateral. As the ratio (V/P) smaller, the curve is more approximates to a quadrilateral. This means that the amount of the intermediate-molecular-weight component which lies between high- and low-molecular-weight components, is great within such range as not to injure the two-peak characteristics.

Accordingly, when there is used a resin having the molecular-weight distribution which is closely extremely approximates a quadrilateral, as shown in the GPC of FIG. 3, the toner agglomeration is prevented. This reduces the rate of a great counter electric charge remaining in the carrier coating layer made of a polymer, thereby to reduce the frequency at which carrier scattering takes place.

DETAILED DESCRIPTION OF THE INVENTION

Figure 1:
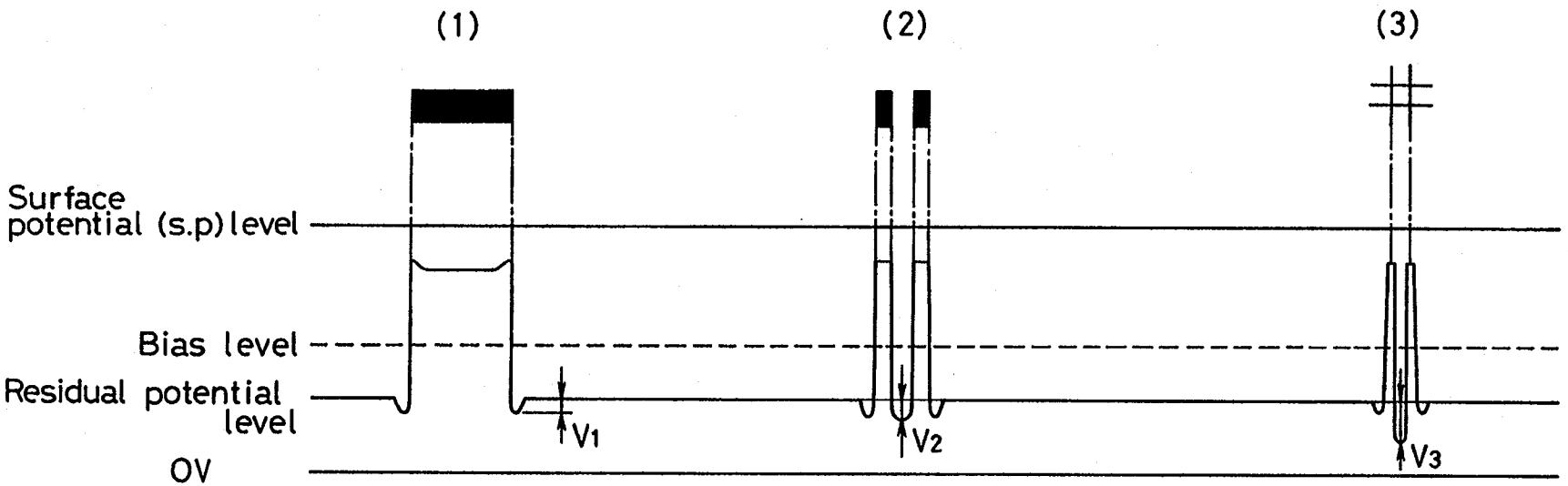
FIG. 1 is a view illustrating the potential patterns of a photosensitive drum respectively obtained at the time when a solid-black pattern, an adjacent-line pattern and a mesh pattern are copied.
Figure 2:
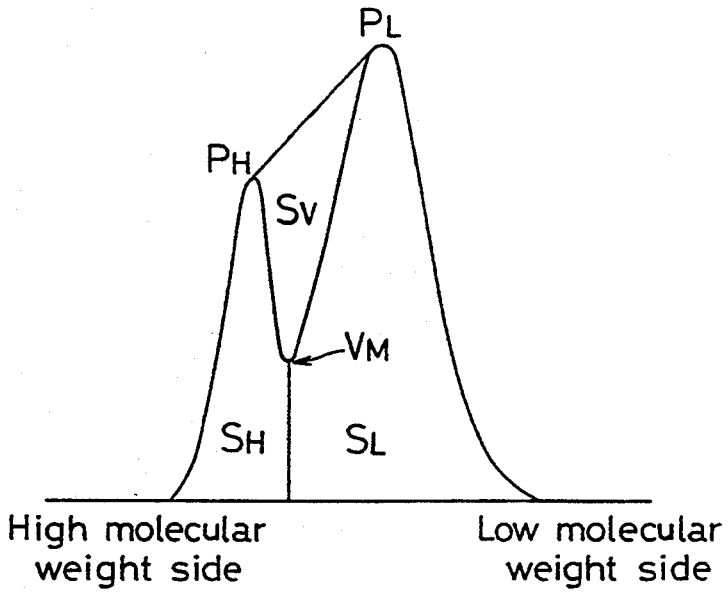
FIG. 2 is a view illustrating how to obtain the area ratio (V/P) of the valley area to the peak area in the molecular-weight distribution of fixing resin components.

The carrier in accordance with the present invention comprises a core material and a coating layer made of a polymer which coats the surface of the core material. As the carrier core material and the polymer material of the coating layer, there may be optionally used any of conventionally used ones.

Examples of the carrier core material include (i) iron powder, oxidized iron powder, reduced iron, magnetite, copper, silicon steel, ferrite, nickel, cobalt and the like, (ii) alloys of any of the metals above-mentioned with manganese, zinc, aluminium and the like, (iii) a magnetic material such as an iron-nickel alloy, an iron-cobalt alloy, an iron-aluminium alloy and the like, (iv) particles obtainable by dispersing a magnetic material in a binder resin, (v) ceramics such as titanium oxide, aluminium oxide, copper oxide, magnesium oxide, lead oxide, zirconium oxide, silicon carbide, magnesium titanate, barium titanate, lithium titanate, lead titanate, lead zirconate, lithium niobate and the like, and (vi) high-permittivity substances such as ADP ($NH_4H_2PO_4$), KDP ($KH_2PO_4$), Rochelle salt and the like. Of these, powder of iron oxide, reduced iron and the like, and ferrite are preferable in view of low cost and excellent image characteristics.

These examples of the carrier core material may be used alone or in combinations of plural types.

The particle size of the carrier core material is in the range from 30 to 200 μm and preferably from 50 to 130 μm.

As preferable examples of the polymer material of the coating layer, there may be used a variety of polymers including: an olefin polymer such as an acrylic polymer, a styrene polymer, a styrene-acrylic copolymer, polyethylene, chlorinated polyethylene, polypropylene and the like; fluoroplastics such as polyvinyl chloride, polyester, unsaturated polyester, polyamide, polyurethane, epoxy resin, polycarbonate, silicone resin, polytetrafluoroethylene, polychlorotrifluoroethylene, polyvinylidene fluoride and the like; phenol resin; xylene resin; diarylphthalate resin and the like. Of these, there are preferably used the acrylic polymer, styrene polymer, styrene-acrylic copolymer, silicone resin or fluorine-containing resin in view of mechanical strength and friction charging properties with respect to the toner.

The polymers above-mentioned may be used alone or in combination of plural types. The coating layer may contain a resistance adjusting agent and/or an electric charge controlling agent.

The carrier core material may be coated with the polymer material by any of conventional methods such as a fluidized bed method, a rolling bed method and the like. For example, when ferrite is used as the carrier core material and a silicone resin is used as the coating layer, the carrier core material may be coated in the following manner.

Ferrite as the carrier core material is put in a coating apparatus of the fluidized bed type, and air is supplied from the lower portion of the coating apparatus to float the ferrite in a flowing state. On the other hand, there is prepared a silicone resin solution in which a predetermined amount of silicone resin is being dissolved in a solvent. From the upper portion of the coating apparatus, this solution is sprayed to the floating and flowing ferrite, which is then coated with the silicone resin.

In the carrier of the two-component developer in accordance with the present invention, the quotient of the resistance value of the carrier core material divided by the carrier resistance value is not less than 0.020, and is preferably from 0.020 to 0.20. If the quotient above-mentioned is less than 0.020, the counter electric charge is liable to remain in the coating layer made of a polymer, so that the carrier scattering is apt to take place.

The toner is in the form of colored fine particles comprising a fixing resin, a coloring agent, an electric charge controlling agent, a release agent and the like.

Examples of the fixing resin include styrene resins (monopolymers and copolymers containing styrene or a styrene substituent) such as polystyrene, chloropolystyrene, poly-α-methylstyrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylate copolymer (a styrene-methyl acrylate copolymer, a styrene-ethyl acrylate copolymer, a styrene-butyl acrylate copolymer, a styrene-octyl acrylate copolymer, a styrene-phenyl acrylate copolymer or the like), a styrene-methacrylate copolymer (a styrene-ethyl methacrylate copolymer, a styrene-butyl methacrylate copolymer, a styrene-phenyl methacrylate copolymer or the like), a styrene-α-methyl chloroacrylate copolymer, a styrene-acrylonitrile-acrylate copolymer and the like. Examples of the fixing resin further include vinyl chloride resin, a styrene-vinyl acetate copolymer, rosin modified maleic acid resin, phenyl resin, epoxy resin, polyester resin, low-molecular-weight polyethylene, low-molecular-weight polypropylene, ionomer resin, polyurethane resin, silicone resin, ketone resin, an ethylene-ethyl acrylate copolymer, xylene resin, polyvinyl butyral and the like. Of these, the styrene resin and the styrene-acrylic resin are preferred. The examples above-mentioned of the fixing resin may be used alone or in combination of plural types.

To produce, as the fixing resin, a styreneacrylic copolymer having the molecular-weight distribution in accordance with the present invention, there are available three methods, i.e., a method of increasing the molecular-weight distribution of a low-molecular-weight resin component ($M_W/M_N$), a method of increasing the ($M_W/M_N$) of a high-molecular-weight resin component, and a method of increasing the ($M_W/M_N$) of the high- and low-molecular-weight resin components. That is, it is enough to increase the overlap of the molecular-weight distributions of both high-and low-molecular-weight resin components. Generally, it is preferable to increase the ($M_W/M_N$) of the high-molecular-weight component in view of various characteristics of toner. The variance of the high molecular-weight component ($M_W/M_N$) is preferably in the range from 2.7 to 3.7, and more preferably from 3.0 to 3.4. The variance of the low-molecular-weight component ($M_W/M_N$) is preferably in the range from 1.5 to 2.5 and more preferably from 1.8 to 2.2. The ratio of $S_H$ to $S_L$ is preferably from 15:85 to 50:50, and more preferably from 20:80 to 45:55.

The styrene-acrylic copolymer to be used in the present invention may be produced either by tightly melting and blending a plurality of types of styrene-acrylic copolymers having different molecular-weight distributions, or by using a two-stage polymerization, so that the styrene-acrylic copolymer presents a molecular-weight distribution in the range above-mentioned.

Figure 4:
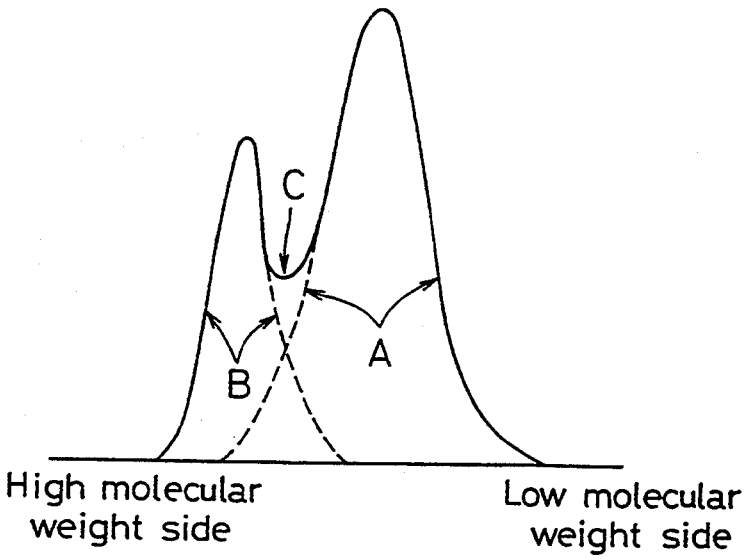
FIG. 4 is a view illustrating how to obtain a resin having a specific molecular-weight distribution in accordance with the present invention.

For example, as shown in FIG. 4, when there are molten and blended, in the same amount, a styrene-acrylic copolymer (low-molecular-weight component) having the molecular-weight distribution shown by a curve A and a styrene-acrylic copolymer (high-molecular-weight component) having the molecular-weight distribution shown by a curve B, there is obtained a styrene-acrylic copolymer having the molecular-weight distribution, shown by a curve C, which is located in the range determined in the present invention.

According to a suspension polymerization or an emulsion polymerization, a polymer having a high molecular weight may be generally produced more easily as compared with a solution polymerization. Accordingly, the styrene-acrylic copolymer having the molecular-weight distribution above-mentioned may be produced by a multi-stage polymerization in which the suspension polymerization or the emulsion polymerization and the solution polymerization are combined in this order or in the reverse order with the molecular weight adjusted at each stage. The molecular weight or molecular-weight distribution may be adjusted by suitably selecting the type or amount of an initiator, the type of a solvent, a dispersing agent or an emulsifying agent relating to chain transfer, and the like.

As a styrene monomer, there may be used vinyl-toluene, α-methylstyrene or the like, besides styrene. As an acrylic monomer, there may be used a monomer represented by the following general formula:

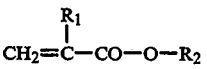

($R^1$ is a hydrogen atom or a lower alkyl group, $R^2$ is a hydrogen atom, a hydrocarbon group having 1 to 12 carbon atoms, a hydroxyalkyl group, a vinylester group or an aminoalkyl group).

Examples of the acrylic monomer represented by the general formula above-mentioned, include acrylic acid, methacrylic acid, methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, ethyl β-hydroxyacrylate, propyl γ-hydroxyacrylate, propyl γ-N,N-diethylaminoacrylate, ethylene glycol dimethacrylate, tetraethylene glycol dimethacrylate and the like.

A styrene(St)/methyl methacrylate(MMA)/butyl acrylate(BA) copolymer may be used as the styrene-acrylic copolymer suitably used for the present invention. There may be preferably used a styrene/methyl methacrylate/butyl acrylate copolymer containing 75 to 85% by weight of styrene, 0.5 to 5% by weight of methyl methacrylate and 10 to 20% by weight of butyl acrylate.

Examples of the coloring agent contained in the toner, include a variety of a coloring pigment, an extender pigment, a conductive pigment, a magnetic pigment, a photoconductive pigment and the like. The coloring agent may be used alone or in combination of plural types according to the application.

Examples of the coloring agent include: a black pigment such as carbon black, acetylene black, aniline black or the like; a yellow pigment such as lead yellow, zinc yellow, cadmium yellow, yellow iron oxide, nickel titanium yellow, Naphthol yellow S, Hansa yellow G, Quinoline yellow lake, permanent yellow NCG, tartrazine lake or the like; an orange pigment such as chrome orange, molybdenum orange, permanent orange GTR or the like; a red pigment such as red iron oxide, cadmium red, red lead, permanent red 4R, Pyrazolone red, lake red D, brilliant carmine 65B, Rhodamine lake B, Alizarine lake, brilliant carmine 3B or the like; a violet pigment such as manganese violet, Fast violet B, methyl violet lake or the like; a blue pigment such as Prussian blue, cobalt blue, partially chlorinated phthalocyanine blue, Fast sky blue, Indanthrene blue BC or the like; a green pigment such as chrome green, chrome oxide green, pigment green B, malachite green lake or the like; a white pigment such as zinc white, titanium oxide, antimony white, zinc sulfide or the like; an extender pigment such as Baryte powder, barium carbonate, clay, silica, talc, alumina white or the like; a conductive pigment such as conductive carbon black, aluminium powder or the like; a magnetic pigment such as a variety of ferrites; a photoconductive pigment such as zinc oxide, selenium, cadmium sulfide, cadmium selenide or the like.

The coloring agent may be used in an amount of 1 to 20 parts by weight and preferably 3 to 15 parts by weight for 100 parts by weights of the fixing resin.

As the electric charge controlling agent contained in the toner, there are available two types, i.e., the positive charge controlling type and the negative charge controlling type.

As the electric charge controlling agent of the positive charge controlling type, there may be used an organic compound having a basic nitrogen atom such as a basic dye, aminopyrine, a pyrimidine compound, a polynuclear polyamino compound, aminosilane, a filler of which surface is treated with any of the substances above-mentioned. As the electric charge controlling agent of the negative charge controlling type, there may be used a compound containing a carboxy group (such as metallic chelate alkyl salicylate or the like), a metal complex salt dye, fatty acid soap, metal salt naphthenate or the like.

The electric charge controlling agent may be used in an amount of 0.1 to 10 parts by weight and more preferably from 0.5 to 8 parts by weight for 100 parts by weight of the fixing resin.

Examples of the toner release agent (off-set preventing agent) include aliphatic resin, aliphatic metal salts, higher fatty acids, fatty esters, its partially saponified substances and the like. Of these, there is preferably used a low-molecular-weight aliphatic resin of which weight average molecular weight is from 1,000 to 10,000. More specifically, there is suitably used one or a combination of plural types of a low-molecular-weight polypropylene, high-molecular-weight polyethylene, paraffin wax, a low-molecular-weight olefin polymer composed of an olefin unit having 4 or more carbon atoms and the like. In addition to the substances above-mentioned, silicone oil, a variety of wax and the like may also be used.

The release agent may be used in an amount of 0.1 to 10 parts by weight and preferably from 0.5 to 8 parts by weight for 100 parts by weight of the fixing resin.

The toner is produced by a method of previously mixing the components above-mentioned uniformly with the use of a dry blender, Henschel mixer, a ball mill or the like, melting and kneading the resultant mixture with the use of a Banbury mixer, a roll, a single- or double-shaft extruding kneader or the like, cooling and grinding the resultant kneaded body, and classifying the resultant ground pieces. The toner particle size is preferably from 3 to 35 μm and more preferably from 5 to 25 μm.

The distribution of toner particle size may be adjusted at the grinding step, as well as the classifying step.

In accordance with the present invention, the toner may contain toner particles having a particle size of not less than 16 μm in an amount of not greater than 1.5%, preferably not greater than 0.88%, and more preferably from 0 to 0.5%, in terms of the number of toner particles. If the toner particles having a particle size of not less than 16 μm is contained in an amount of not less than 1.5%, a great counter electric charge remains in the carrier coating layer made of a polymer, resulting in frequent occurrence of the carrier scattering. As the carrier scattering takes place more often, a line image and a mesh image is lowered in reproducibility.

In accordance with the present invention, the toner conductivity is preferably not less than $3.0\times10^{-10}$ S/cm. If the toner conductivity is smaller than $3.0\times10^{-10}$ S/cm, the counter electric charge remaining in the carrier coating layer is increased so that the carrier scattering is liable to take place.

The toner conductivity may be adjusted by selecting the blending amount of the coloring agent such as carbon black or the like in the range from 5 to 15 parts by weight for 100 parts by weight of the toner. The toner conductivity may also be adjusted by adjusting the dispersion of the coloring agent. The dispersion of the coloring agent may be adjusted by the operation conditions of the mixing and kneading apparatus.

In accordance with the present invention, the toner compression degree is preferably not greater than 40%. Excessive toner compression degree over 40% increases the dispersion of the amount of toner particles stuck to each carrier, thereby to increase the counter electric charge in the carrier coating layer after development. Accordingly, the carrier scattering is apt to take place.

To adjust the toner compression degree, a flowability imparting agent such as hydrophobic silica, titanium oxide, alumina or the like may be added in an amount from 0.05 to 3 parts by weight for 100 parts by weight of the toner. The toner compression degree may also be adjusted by adjusting the toner particle size, particle size distribution, shape and the like.

EXAMPLES

The following description will discuss in detail the two-component developer of the present invention with reference to Examples thereof and Comparative Examples.

Examples 1 to 5 and Comparative Examples 1 to 3
(Relationship between the resistance value of the coating layer and the toner particle size)

(1) Preparation of Carrier

Core material : Ferrite particles
Average particle size: abt. 100 μm
Saturation magnetization: 50 emu/g
Polymer for the coating layer:
Styrene-acrylic copolymer Each of carriers respectively having different resistance values was prepared with the coating layer formed by coating the surface of the core material above-mentioned with the polymer above-mentioned by a flow-coating method. The resistance values of the carriers thus prepared are shown in Table 1. The quotient of the resistance value of the carrier core material divided by the carrier resistance value was obtained from each of the carrier resistance values and the previously obtained resistance value of the carrier core material. The carrier resistance value was measured in the following manner.

[Method of measuring the carrier resistance value]

In imitation of a magnetic brush developing method, N and S poles were placed opposite to each other with a distance of 5 mm provided therebetween. In each magnetic pole, the surface magnetic flux density was 1500 Gauss, while the opposite magnetic pole area was 10×30 mm. Between the magnetic poles, parallel flat electrodes were placed with a distance of 2mm provided therebetween. Then, 200 mg of each sample was put between the electrodes and held by a magnetic force. The resistance value was then measured with an insulation resistance tester or an ammeter.

(2) Preparation of Toner

| (Component) | (Parts by Weight) |
|---|---|
| Styrene-acrylic copolymer | 100.0 |
| Carbon black | 8.5 |
| Charge controlling agent (monoazo-type dye) | 3.0 |
| Low-molecular-weight polypropylene | 1.8 |

The components above-mentioned in the amounts above-mentioned were mixed, molten, kneaded, cooled, ground and classified to prepare toners presenting different rates, in terms of the number of particles, of toner particles having a particle size of not less than 16 μm. These rates are shown in Table 1.

The toner particle size was measured with a coalter counter TA-II (100 μm aperture) manufactured by Nikkaki Co., Ltd.

Each of the carriers above-mentioned and each of the toners above-mentioned were mixed at a ratio of 100:3.5 by weight to prepare a developer.

[Evaluation Test of Carrier Scattering]

Each of the developers of Examples 1 to 5 and Comparative Examples 1 to 3 was mounted on a copying apparatus (DC3255 manufactured by Mita Industrial Co., Ltd.). There was prepared a mesh chart in which 30 mesh patterns were being attached, each mesh pattern containing a plurality of parallel straight lines which were transversely and longitudinally drawn at regular intervals of about 0.57 mm in a regular square of which each side had a length of 24 mm. As a document, this mesh chart was copied by 5,000 pieces with the copying apparatus above-mentioned using each of the developers. Five copied pieces were sampled at each of seven times, i.e., the starting, 500th, 1,000th, 2,000th, 3,000th, 4,000th and 5,000th times. All the extracted copies were checked for blanking due to carrier scattering and evaluated according to the following standards. The results are also shown in Table 1.

O . . . Presence of not greater than 9 blankings

X . . . Presence of not less than 10 blankings

Each initial image density (ID) was measured with a reflection densitometer (Model TC-6D) manufactured by Tokyo Denshoku Co., Ltd. Table 1 also shows the results.

In Table 1, the core material resistance value refers the resistance value of the carrier core material.

material divided by the carrier resistance value was less than 0.020, many carrier scatterings were observed and the initial image density was low as compared with Examples 1 to 5, even though the rate of the large toner particles having a particle size of not less than 16 μm was as small as 0.45%. In Comparative Example 3, the quotient of the resistance value of the carrier core material divided by the carrier resistance value was not less than 0.020 and the image initial density was as high as 1.37. However, since Comparative Example 3 contained large toner particles having a particle size of not less than 16 μm in an amount of 1.80%, the carrier scattering occurred to produce many blankings.

Examples 6 to 10 and Comparative Examples 4 to 6

(Relationship between the resistance value of the coating layer and the toner conductivity)

(1) Preparation of Carrier

Carriers were prepared in the same manner as in Examples 1 to 5. Table 2 shows the carrier resistance value and the quotient of the resistance value of the carrier core material divided by the carrier resistance value of each of the carriers thus prepared.

(2 ) Preparation of Toner

| (Component) | (Parts by Weight) |
|---|---|
| Styrene-acrylic copolymer | 100.0 |
| Charge controlling agent (monoazo-type dye) | 3.0 |
| Low-molecular-weight polypropylene | 1.8 |

Added to the components above-mentioned in the amounts above-mentioned was carbon black in each of the amounts (parts by weight) shown in Table 2. The resultant adducts were mixed, molten, kneaded, cooled, ground and classified, thereby to prepare toners respectively having different conductivities, which are also shown in Table 2.

The rate of toner particles having a particle size of not less than 16 μm in terms of the number of particles was 0.45% in each of Examples 6 to 9, and 1.35% in Example 10. In each of Examples 1 to 10, the toner compression degree was 37.4%. To adjust the compression degree, 0.3 parts by weight of hydrophobic silica was added for 100 parts by weight of each toner.

The toner conductivity was measured in the following manner.

TABLE 1

| | Example 1 | Example 2 | Example 3 | Example 4 | Example 5 | Comparative Example 1 | Comparative Example 2 | Comparative Example 3 |
|---|---|---|---|---|---|---|---|---|
| Carrier resistance value ($\times 10^8$) | 3.3 | 2.3 | 1.5 | 8.2 | 3.3 | 10.0 | 3.1 | 3.3 |
| (Core material resitance value)/(Carrier resistance value) | 0.024 | 0.070 | 0.103 | 0.195 | 0.024 | 0.016 | 0.017 | 0.024 |
| Concentration of toner particles with particle size of not less than 16 μm | 0.45 | 0.45 | 0.45 | 0.45 | 1.35 | 0.45 | 0.45 | 1.80 |
| Initial image density | 1.35 | 1.39 | 1.42 | 1.41 | 1.37 | 1.32 | 1.32 | 1.37 |
| Carrier scattering | O | O | O | O | O | X | X | X |

As apparent from Table 1, no carrier scattering occurred to restrain blanking to such an extent as to present no substantial problem in practical use in each of Examples 1 to 5 in which the quotient of the resistance value of the carrier core material divided by the carrier resistance value was not less than 0.020.

In each of Comparative Examples 1 and 2 in which the quotient of the resistance value of the carrier core

[Method of measuring the toner conductivity]

A Space between parallel flat electrodes (electrodes for powder manufactured by Ando Denki Co., Ltd. ) was filled with each of the toners with a void volume of 25%. While an AC voltage of 100 KHz in which the peak-to-peak voltage was from +1V to −1V, was applied, the conductivity of each toner was measured.

An electrode having an electrode area of 2.27 $cm^2$ was used as each of the electrodes above-mentioned. Each toner was loaded such that the electrode distance was 0.5 mm±0.1 mm.

Each of the carriers and each of the toners obtained in the respective manners above-mentioned were mixed with each other at a ratio of 100:3.5, thereby to prepare a developer. Each developer thus obtained was evaluated as to carrier scattering and initial image density. The results are shown in Table 2.

O . . . Presence of not greater than 9 blankings

X . . . Presence of not less than 10 blankings

TABLE 2

| | Example 6 | Example 7 | Example 8 | Example 9 | Example 10 | Comparative Example 4 | Comparative Example 5 | Comparative Example 6 |
|---|---|---|---|---|---|---|---|---|
| Amount of carbon black (parts by weight) | 8.5 | 8.5 | 8.5 | 8.5 | 7.5 | 8.5 | 8.5 | 7.0 |
| Carrier resistance value ($\times 10^8$) | 3.3 | 2.3 | 1.5 | 8.2 | 3.3 | 10.0 | 3.1 | 3.3 |
| (Core material resitance value)/(Carrier resistance value) | 0.024 | 0.070 | 0.103 | 0.195 | 0.024 | 0.016 | 0.017 | 0.024 |
| Toner conductivity ($\times 10^{-10}$ S/cm) | 8.5 | 8.5 | 8.5 | 8.5 | 3.8 | 8.5 | 8.5 | 2.4 |
| Initial image density | 1.35 | 1.39 | 1.42 | 1.41 | 1.34 | 1.32 | 1.32 | 1.30 |
| Carrier scattering | ○ | ○ | ○ | ○ | ○ | X | X | X |

As apparent from Table 2, no carrier scattering occurred to restrain blanking to such an extent as to present no substantial problem in practical use in each Examples 6 to 10 in which the quotient of the resistance value of the carrier core material divided by the carrier resistance value was not less than 0.020. On the other hand, in each of Comparative Examples 4 and 5 in which the quotient of the resistance value of the carrier core material divided by the carrier resistance value was less than 0.020, many carrier scatterings were observed and the initial image density was low as compared with Examples 6 to 10, even though the toner conductivity was identical with that of each of Examples 6 to 10. In Comparative Example 6, the quotient of the resistance value of the carrier core material divided by the carrier resistance value was not less than 0.020. However, since the toner conductivity was as low as 2.4×10 S/cm, the carrier scattering occurred to produce many blankings.

Examples 11 to 16 and Comparative Examples 7 to 9

(Relationship between the resistance value of the coating layer and the toner compression degree)

(1) Preparation of Carrier

Carriers were prepared in the same manner as in Examples 1 to 5. Table 3 shows the carrier resistance value and the quotient of the resistance value of the carrier core material divided by the carrier resistance value of each of the carriers thus prepared.

(2) Preparation of Toner

| (Component) | (Parts by Weight) |
|---|---|
| Styrene-acrylic copolymer | 100.0 |
| Carbon black | 8.5 |
| Charge controlling agent (monoazo-type dye) | 3.0 |
| Low-molecular-weight polypropylene | 1.8 |

The components above-mentioned in the amounts above-mentioned were mixed, molten, kneaded, cooled, ground and classified, thereby to prepare toners. To adjust the compression degree, there was added to, 100 parts by weight of each toner, hydrophobic silicas in each of the amounts (parts by weight) which are also shown in Table 2. The adduct of each toner with hydrophobic silica was mixed with an agitator. Table 3 also shows the compression degree of each toner thus obtained.

Each toner compression degree was measured with the use of a powder tester manufactured by Hosokawa Micron Co., Ltd. in the manner above-mentioned.

Each of the carriers and each of the toners obtained in the respective manners above-mentioned were mixed at a ratio of 100:3.5 to prepare a developer. Each developer was evaluated as to carrier scattering and initial image density in the same manner as in Examples 1 to 5. The results are also shown in Table 3.

O . . . Presence of not greater than 9 blankings

X . . . Presence of not less than 10 blankings

TABLE 3

| | Example 11 | Example 12 | Example 13 | Example 14 | Example 15 | Example 16 | Comparative Example 7 | Comparative Example 8 | Comparative Example 9 |
|---|---|---|---|---|---|---|---|---|---|
| Amount of silica (parts by weight) | 0.3 | 0.3 | 0.3 | 0.3 | 0.2 | 0.5 | 0.3 | 0.3 | 0.1 |
| Carrier resistance value ($\times 10^8$) | 3.3 | 2.3 | 1.5 | 8.2 | 3.3 | 3.3 | 10.0 | 3.1 | 3.3 |
| (Core material resitance value)/(Carrier resistance value) | 0.024 | 0.070 | 0.103 | 0.195 | 0.024 | 0.024 | 0.016 | 0.017 | 0.024 |
| Toner compression degree (%) | 37.4 | 37.4 | 37.4 | 37.4 | 39.2 | 32.0 | 37.4 | 37.4 | 40.9 |
| Iitial image density | 1.35 | 1.39 | 1.42 | 1.41 | 1.32 | 1.36 | 1.32 | 1.32 | 1.31 |
| Carrier scattering | ○ | ○ | ○ | ○ | ○ | ○ | X | X | X |

As apparent from Table 3, no carrier scattering occurred to restrain blanking to such an extent as to present no substantial problem in practical use in each Examples 11 to 16 in which the quotient of the resistance value of the carrier core material divided by the carrier resistance value was not less than 0.020. On the other hand, in each of Comparative Examples 7 and 8 in which the quotient of the resistance value of the carrier core material divided by the carrier resistance value was small, many carrier scatterings were observed and the initial image density was low as compared with Examples 11 to 16, even though the toner compression degree was as small as 37.4 and the flowability was good. In Comparative Example 9, the quotient of the resistance value of the carrier core material divided by the carrier resistance value was not less than 0.020. However, since the toner compression degree was 40.9%, the toner flowability was bad and the carrier scattering occurred.

Examples 17 to 20 and Comparative Examples 10 to 11 (Relationship between the resistance value of the coating layer and the molecular-weight distribution of resin for toner)

(1) Preparation of Carrier

Carriers were prepared in the same manner as in Examples 1 to 5. Table 4 shows the carrier resistance value and the quotient of the resistance value of the carrier core material divided by the carrier resistance value of each of the carriers thus prepared.

(2) Preparation of Toner

Figure 3:
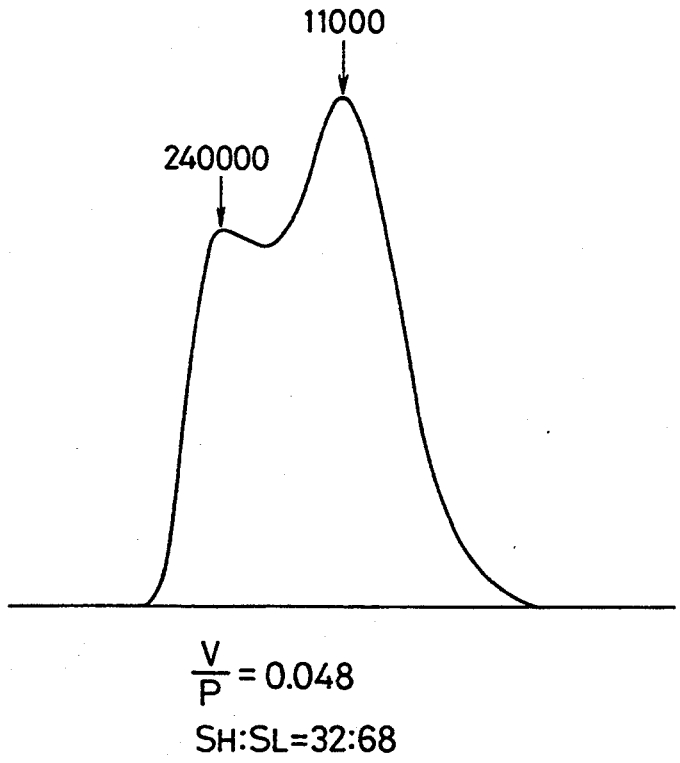
FIG. 3 is a gel permeation chromatogram showing the molecular-weight distribution of a resin used in each of Examples 17 to 20 and Comparative Example 1 to 2.

There were mixed (i) 100 parts by weight of a styrene (St)/methyl methacrylate (MMA)/butyl acrylate (BA) copolymer (St:MMA:BA=75:5:20), (ii) 8 parts by weight of carbon black as the coloring agent, (iii) 1 part by weight of a negative-polarity dye as the charge controlling agent, and (iv) 1 part by weight of low-molecular-weight polypropylene. In the copolymer above-mentioned, the high-molecular-weight side peak value was 240,000 with $M_W/M_N$ of 3.0, the low molecular-weight side peak value was 11,000 with $M_W/M_N$ of 2.2, and the GPC was as shown in FIG. 3 (V/P=0.048, $S_H$:$S_L$=32:68). After molten and kneaded, the resulting mixture was cooled, ground and classified to produce toner. Then, 0.2 parts by weight of hydrophobic silica was mixed with 100 parts of the toner thus prepared.

The carrier and toner thus obtained were mixed at a ratio by weight of 100:3.5 to prepare a developer.

The developer was measured as to carrier scattering and initial image density in the same manner as in Examples 1 to 5. A fixing property test was also conducted in the following manner.

While the temperature set to the heating rollers of a modified copying apparatus DC-5585 manufactured by Mita Industrial Co., Ltd. (of the heating pressure roller fixing type) was raised in steps of 2.5° C. from 140° C., paper having thereon a toner image was passed in the apparatus, causing the image to be fixed. An adhesive tape was pressingly contacted with the fixed image and then separated. The density data of the fixed image before and after separation were measured with the reflection densitometer above-mentioned. According to the following equation, there was obtained the lowest temperature at which the fixing ratio reached 90%.

Fixing ratio (%)=(Image density after separation-/Image density before separation)×100

Further, a high-temperature off-set generating temperature was also obtained.

Table 4 also shows the results of these tests.

EXAMPLE 21

(Relationship between the resistance value of the coating layer and the molecular-weight distribution of resin for toner)

(1) Preparation of Carrier

A carrier was prepared in the same manner as in Examples 1 to 5. Table 4 also shows the carrier resistance value and the the quotient of the resistance value of the carrier core material divided by the carrier resistance value.

(2) Preparation of Toner

Figure 5:
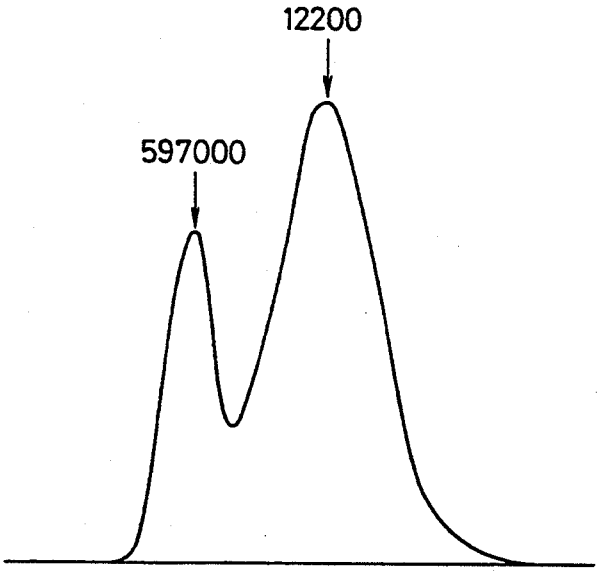
FIG. 5 is a gel permeation chromatogram presenting the molecular-weight distribution of a resin used in Example 21.

Toner was prepared in the same manner as in Examples 17 to 20 and Comparative Examples 10 and 11 except for the use of a styrene (St)/methyl methacrylate (MMA)/butyl acrylate (BA) copolymer (St:MMA:BA=80:5:15), in which the high-molecular-weight side peak value was 597,000 with $M_W/M_N$ of 3.1, and the low molecular-weight side peak value was 12,200 with $M_W/M_N$ of 1.95, and of which GPC was as shown in FIG. 5 (V/P=0.14, $S_H$:$S_L$=25:75).

The tests above-mentioned were conducted on this toner. The results are also shown in Table 4.

Comparative Example 12

(1) Preparation of Carrier

A carrier was prepared in the same manner as in Examples 17 to 21 and Comparative Examples 10 and 11, and the resistance value of the carrier thus prepared was measured.

(2) Preparation of Toner

Figure 6:
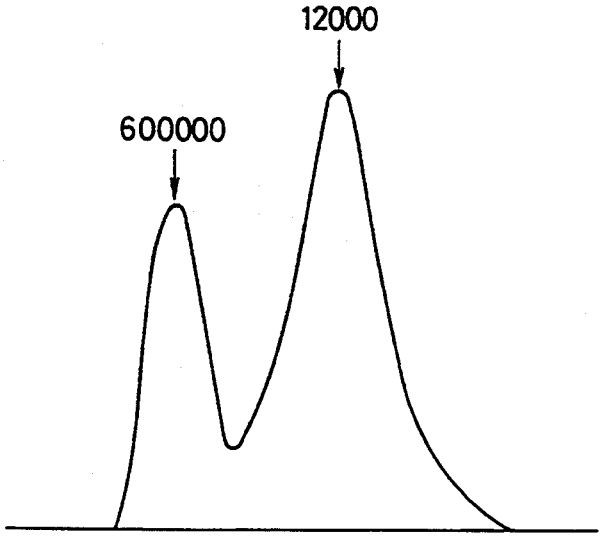
FIG. 6 is a gel permeation chromatogram presenting the molecular-weight distribution of a resin used in Comparative Example 12.

Toner was prepared in the same manner as in Examples 17 to 21 and Comparative Examples 10 and 11 except for the use of a styrene ( St )/methyl methacrylate (MMA)/butyl acrylate (BA) copolymer (St:MMA:BA=83:5:12) , in which the high-molecular-weight side peak value was 600,000 with $M_W/M_N$ of 3.0, and the low-molecular-weight side peak value was 12,000 with $M_W/M_N$ of 2.0, and of which GPC was as shown in FIG. 6 (V/P=0.309, $S_H$:$S_L$=30:70).

The tests above-mentioned were conducted on this toner. The results are also shown in Table 4.

Comparative Example 13

(1) Preparation of Carrier

A carrier was prepared in the same manner as in Examples 17 to 21 and Comparative Examples 10 and 11, and the resistance value of the carrier thus prepared was measured.

(2) Preparation of Toner

Figure 7:
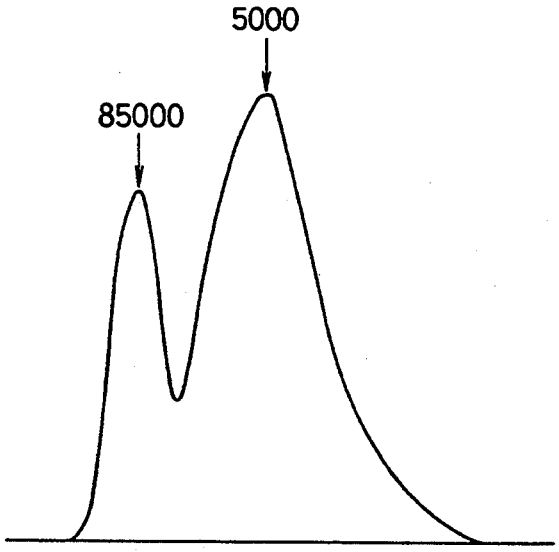
FIG. 7 is a gel permeation chromatogram presenting the molecular-weight distribution of a resin used in Comparative Example 13.

Toner was prepared in the same manner as in Examples 17 to 21 and Comparative Examples 10 and 11 except for the use of a styrene (St)/methyl methacrylate (MMA)/butyl acrylate (BA) copolymer (St:MMA:BA=4:14), in which the high-molecular-weight side peak value was 85,000 with $M_W/M_N$ of 3.0, and the low molecular-weight side peak value was 5,000 with $M_W/M_N$ of 2.3, and of which GPC was as shown in FIG. 7 (V/P=0,152, $S_H$:$S_L$=24:76).

The tests above-mentioned were conducted on this toner. The results are also shown in Table 4.

O . . . Presence of not greater than 9 blankings

X . . . Presence of not less than 10 blankings

TABLE 4

| | Example 17 | Example 18 | Example 19 | Example 20 | Example 21 | Comparative Example 10 | Comparative Example 11 | Comparative Example 12 | Comparative Example 13 |
|---|---|---|---|---|---|---|---|---|---|
| Carrier resistance value ($\times 10^8$) | 3.3 | 2.3 | 1.5 | 8.2 | 3.3 | 10.0 | 3.1 | 3.3 | 3.3 |

TABLE 4-continued

| | Example 17 | Example 18 | Example 19 | Example 20 | Example 21 | Comparative Example 10 | Comparative Example 11 | Comparative Example 12 | Comparative Example 13 |
|---|---|---|---|---|---|---|---|---|---|
| (Core material resistance value)/(Carrier resistance value) | 0.024 | 0.070 | 0.103 | 0.195 | 0.024 | 0.016 | 0.017 | 0.024 | 0.024 |
| V/P | 0.048 | 0.048 | 0.048 | 0.048 | 0.140 | 0.048 | 0.048 | 0.309 | 0.152 |
| $S_H/S_L$ | 32:68 | 32:68 | 32:68 | 32:68 | 25:75 | 32:68 | 32:68 | 30:70 | 24:76 |
| $S_H$ | 240000 | 240000 | 240000 | 240000 | 597000 | 240000 | 240000 | 600000 | 85000 |
| $S_L$ | 11000 | 11000 | 11000 | 11000 | 12200 | 11000 | 11000 | 12000 | 5000 |
| Initial image density | 1.35 | 1.39 | 1.42 | 1.41 | 1.37 | 1.32 | 1.32 | 1.38 | 1.43 |
| Carrier scattering | ○ | ○ | ○ | ○ | ○ | X | X | X | X |
| Lowest fixing temp. (°C.) | 145 | 145 | 145 | 145 | 150 | 145 | 145 | 160 | 150 |
| High-temp. off-set generating temp. (°C.) | 185 | 185 | 185 | 185 | 190 | 185 | 185 | 180 | 180 |

As apparent from Table 4, no carrier scattering occurred to restrain blanking to such an extent as to present no substantial problem in practical use in each of Examples 17 to 21 in which the quotient of the resistance value of the carrier core material divided by the carrier resistance value was not less than 0.020. Further, it was found that, in each of Examples 17 to 21, the difference between the lowest fixing temperature and the high-temperature off-set generating temperature was great to provide a broad area for the image fixable temperature, and the amount of spent toner was small.

In each of Comparative Examples 10 and 11 in which the quotient of the resistance value of the carrier core material divided by the carrier resistance value was small, many carrier scatterings were observed and the initial image density was low as compared with Examples 17 to 21. In each of Comparative Examples 12 and 13, the quotient of the resistance value of the carrier core material divided by the carrier resistance value was not less than 0.020 and the initial image density was high. However, since any of the high-molecular-weight side peak position, the low-molecular-weight side peak position and the value V/P of the fixing resin components, deviated from the range determined in the present invention, the carrier scattering occurred to produce many blankings. Further, the fixing properties of each of Comparative Examples 12 and 13 was inferior to Examples 17 to 21.

Thus, the two-component developers of Examples 1 to 21 produced no carrier scattering, thereby to produce substantially no blanking, and presented excellent image initial density. Accordingly, the developers above-mentioned were superior to Comparative Example s 1 to 13.

What is claimed is:

1. A two-component developer comprising toner and a carrier, said carrier having a core material coated with a surface coating layer made of a styrene-acrylic thermoplastic resin, wherein the quotient of the resistance value of said carrier core material divided by the carrier resistance value is from 0.020 to 0.200, and wherein the fixing resin of said toner is a styrene-acrylic thermoplastic resin having a gel permeation chromatogram which shows a molecular-weight distribution having a high-molecular-weight maximum value located in a side higher than the molecular weight of $1\times10^5$, a low-molecular-weight maximum value located in a range of molecular weight from $2\times10^4$ to 500 and a minimum value located between said two maximum values, and having a ratio (V/P) of the area of a valley area V containing said minimum value and located under a line tangential to said maximum values to a total sum P of high- and low-molecular-weight peak areas of the chromatograph, not greater than 0.30.

2. A two-component developer according to claim 1, wherein said toner contains particles having a particle size of not less than 16 μm in an amount of not greater than 1.5% in terms of the number of toner particles.

3. A two-component developer according to claim 1, wherein the conductivity of the toner is not less than $3.0\times10^{-10}$ S/cm.

4. A two-component developer according to claim 1, wherein the compression degree of the toner is not greater than 40%.

5. A two-component developer according to claim 1, wherein said core material is a ferrite particulate material.

6. A two-component developer according to claim 1, wherein said core material is an iron powder.

* * * * *